US009010307B2

(12) United States Patent
Jolley et al.

(10) Patent No.: US 9,010,307 B2
(45) Date of Patent: Apr. 21, 2015

(54) LIMB BOLT SYSTEM

(75) Inventors: Gideon S. Jolley, Syracuse, UT (US); Douglas E. Denton, Stansbury Park, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 474 days.

(21) Appl. No.: 13/220,446

(22) Filed: Aug. 29, 2011

(65) Prior Publication Data

US 2013/0047971 A1 Feb. 28, 2013

(51) Int. Cl.
*F41B 5/10* (2006.01)
*F41B 5/00* (2006.01)

(52) U.S. Cl.
CPC ..... *F41B 5/0026* (2013.01); *F41B 5/0031* (2013.01)

(58) Field of Classification Search
USPC ..... 124/23.1
See application file for complete search history.

(56) References Cited

U.S. PATENT DOCUMENTS

| | | | | | |
|---|---|---|---|---|---|
| 4,793,319 | A * | 12/1988 | Vaughan et al. | ..... | 124/25.6 |
| 5,231,970 | A * | 8/1993 | Ploot et al. | ..... | 124/23.1 |
| 5,879,389 | A * | 3/1999 | Koshino | ..... | 623/20.11 |
| 5,902,085 | A * | 5/1999 | Yuta | ..... | 411/433 |
| 6,261,291 | B1 * | 7/2001 | Talaber et al. | ..... | 606/281 |
| 6,458,133 | B1 * | 10/2002 | Lin | ..... | 606/279 |

* cited by examiner

*Primary Examiner* — Alvin Hunter
*Assistant Examiner* — Amir Klayman
(74) *Attorney, Agent, or Firm* — Holland & Hart

(57) ABSTRACT

A traditional archery bow assembly includes a handle assembly, a bowstring, and a first limb bolt assembly. The handle assembly includes a riser, an upper limb, and a lower limb, wherein the upper and lower limbs each include a distal end and a proximal end connected to the riser. The bowstring extends between the distal ends of the upper and lower limbs. The first limb bolt assembly is operable to connect one of the upper and lower limbs to the riser. The first limb bolt assembly includes a shank portion and a head portion, wherein the head portion defines a contact surface that faces and contacts the one of the upper and lower limbs, and is pivotable relative to the shank portion.

19 Claims, 10 Drawing Sheets

LIMB BOLT SYSTEM

TECHNICAL FIELD

The present disclosure is directed to archery bows, and more particularly to limb bolt systems for securing a limb to a riser of a recurve bow.

BACKGROUND

Traditional archery bows (e.g., longbows and recurve bows) typically include a pair of oppositely extending limbs connected to a riser. The riser is often configured as a separate, disconnectable structure from the limbs. The bowstring is attached directly to distal ends of the limbs. When the archer draws the bowstring, the limbs store energy to propel an arrow upon release of the bowstring.

An advantage related to traditional archery bows that have disconnectable limbs is that the bow can be broken down for storage and traveling purposes. There may be a need to break down traditional bows frequently because of transportation needs.

Breaking down a bow (i.e., removing the limbs from the riser) may result in losing some of the fine-tuned adjustments of the bow. New adjustments may need to be made after assembly. Many different tuning adjustments may be done to an archery bow to ensure accuracy of arrow flight and repeatability of performance of the bow. One adjustment is the "tiller" of each of the limbs. The tiller of a bow limb is the perpendicular distance between the bow string and the limb. This distance is typically measured where the bow limb attaches to the riser. The tiller of each limb may be separately measured and adjusted. The tiller for a given bowstring length is typically controlled by adjusting the limb bolts that are used to connect the limbs to the riser.

The riser for a recurve bow includes separate limb pockets at opposing ends that receive ends of the limbs. The limb bolt is connected to the riser within or adjacent to the limb pocket. Each limb typically includes an open slot formed in an end thereof that extends into the pocket and receives the limb bolt. Tightening the limb bolt captures the limb between a head of the bolt and a surface of the limb pocket of the riser.

Opportunities exist for improvements in connecting limbs to the riser in a traditional bow to provide repeatable, secure attachment with consistent adjustment features such as tiller.

SUMMARY

One aspect of the present disclosure relates to a traditional archery bow assembly that includes a handle assembly, a bowstring, and a first limb bolt assembly. The handle assembly includes a riser, an upper limb, and a lower limb, wherein the upper and lower limbs each includes a distal end and a proximal end connected to the riser. The bowstring extends between the distal ends of the upper and lower limbs. The first limb bolt assembly is operable to connect one of the upper and lower limbs to the riser. The first limb bolt assembly includes a shank portion and a head portion, wherein the head portion defines a contact surface that faces and contacts the one of the upper and lower limbs, and is movable relative to the shank portion.

The shank portion may include a shank bearing surface and the head portion includes a head bearing surface that slidably interfaces with the shank bearing surface to provide relative movement between the shank and head portions. The shank portion may include a convex bearing surface and the head portion may include a concave bearing surface that interfaces with the convex bearing surface. The head portion may include a bottom connector and a top connector, wherein the bottom connector includes the head bearing surface, and the top connector is operable to secure the bottom connector to the shank portion. At least one of the bottom connector and the top connector may define a planar limb contact surface that maintains contact with the one of the upper and lower limbs during angled adjustment of the one of the upper and lower limbs relative to the riser. The entire limb contact surface may maintain contact with the one of the upper and lower limbs during angled adjustment. The head portion may further include a cover plate mounted to the head portion on a side of the head portion opposite the upper or lower limb.

The head portion may further include a limb interface member that defines an interface between the head portion and the one of the upper and lower limbs. The shank portion may include a threaded end that threadably engages a threaded bore of the riser. The head portion may be pivotal relative to the shank portion.

Another aspect of the present disclosure relates to a recurve archery bow handle assembly that includes a riser, upper and lower limbs extending from opposite ends of the riser, and a limb bolt assembly. The limb bolt assembly is configured to releasably connect one of the upper and lower limbs to the riser. The limb bolt assembly includes a shank portion having a shank head and including a shank bearing surface. The head portion includes a bottom connector and a top connector, wherein the bottom connector includes a head bearing surface that interfaces with the shank bearing surface to provide pivotal movement between the shank portion and the head portion, and the top connector connects the bottom connector to the shank portion.

The head portion may remain in contact with the upper or lower limb when adjusting an angled orientation of the upper or lower limb relative to the riser. The shank portion and head portion may include mating hemispherical bearing surfaces to provide the pivotal movement. Moving the shank portion into and out of threaded engagement with the riser adjusts an angled orientation of the upper or lower limb relative to the riser.

Another aspect of the present disclosure relates to a method of assembling a traditional archery bow. The method includes providing a riser, upper and lower limbs, and a first limb bolt assembly, wherein the first limb bolt assembly includes a shank portion and a head portion that is pivotable relative to the shank portion. The method also includes threadably connecting the first limb bolt assembly to the riser, positioning a proximal end of one of the upper and lower limbs between the riser and the first limb bolt assembly, adjusting the first limb bolt assembly relative to the riser to change an angled orientation of the one of the upper and lower limbs relative to the riser, and pivoting the head portion relative to the shank portion while adjusting the one of the upper and lower limbs relative to the riser.

The method may also include providing a second limb bolt assembly, positioning a proximal end of the other of the upper and lower limbs between the riser and the second limb bolt assembly, adjusting the second limb bolt assembly relative to the riser to change an angled orientation of the other of the upper and lower limbs relative to the riser, and pivoting the head portion relative to the shank portion of the second limb bolt assembly while adjusting the other of the upper and lower limbs relative to the riser.

The shank portion may include a convex bearing surface and the head portion may include a concave bearing surface that interfaces with the convex bearing surface. The head portion may include a planar limb contact surface that faces and maintains contact with the one of the upper and lower limbs during adjusting of the one of the upper and lower limbs relative to the riser. Adjusting the first limb bolt assembly relative to the riser includes moving the shank portion into and out of the riser. The head portion may include a bottom connector and a top connector, wherein the bottom connector has a shank bearing surface, the shank portion extends through the bottom connector, and the top connector threadably connects the bottom connector to the shank portion.

The foregoing and other features, utilities, and advantages of the subject matter described herein will be apparent from the following more particular description of certain embodiments as illustrated in the accompanying drawings.

DETAILED DESCRIPTION

Reference is made in the following to a number of illustrative embodiments of the subject matter described herein. The following embodiments illustrate only a few selected embodiments that may include the various features, characteristics, and advantages of the subject matter as presently described. Accordingly, the following embodiments should not be considered as being comprehensive of all of the possible embodiments. Also, features and characteristics of one embodiment may and should be interpreted to equally apply to other embodiments or be used in combination with any number of other features from the various embodiments to provide further additional embodiments, which may describe subject matter having a scope that varies (e.g., broader, etc.) from the particular embodiments explained below. Accordingly, any combination of any of the subject matter described herein is contemplated.

The present disclosure is directed to an apparatus used for connecting limbs to a riser of an archery bow. Some aspects of the present disclosure may be directed specifically to a recurve bow, which is one type of traditional archery bow.

One aspect of the present disclosure relates to a limb bolt system or assembly for use in a traditional archery bow such as a recurve bow. The limb bolt assembly is used to connect a limb to a riser of the bow. The limb bolt assembly includes a head portion that pivots relative to a shank portion. The head portion includes a limb contact surface having a surface area that maintains contact with a primary surface of the limb while adjusting the limb bolt relative to the riser to connect the limb to the riser during assembly of the bow. The limb bolt includes mating contoured surfaces that permit pivotal movement of the head portion relative to the shank portion. The contoured surfaces may be hemispherical in shape. In some arrangements, the head portion is pivotable through a range of motion having an angle of about 45 degrees to 135 degrees relative to a length dimension of the shank portion.

Figure 12:
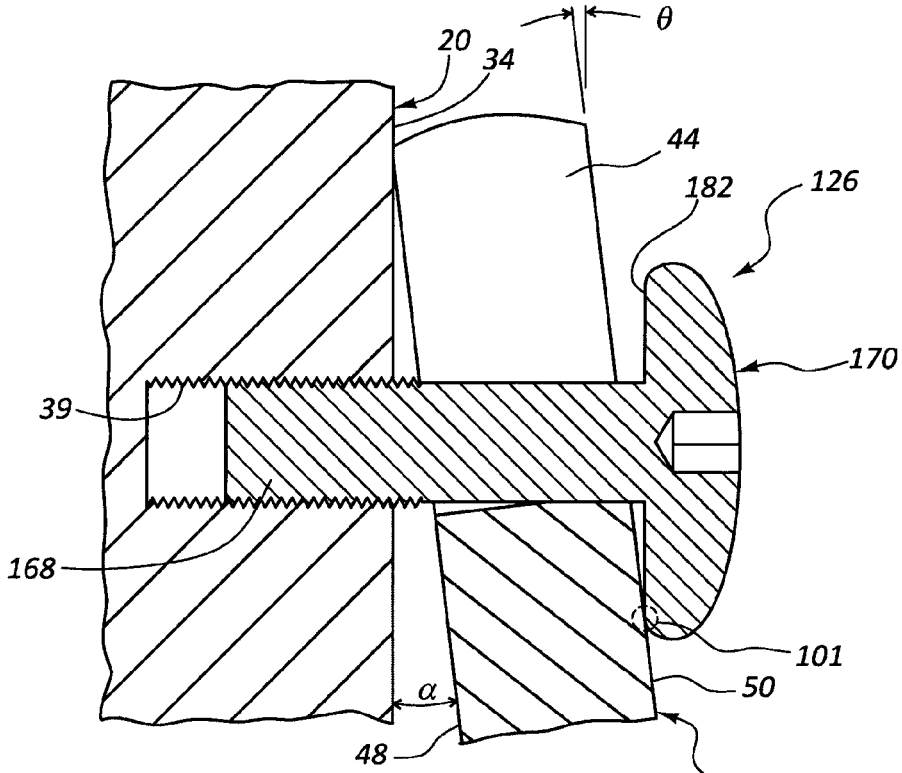
FIG. 12 (Prior Art)
FIG. 12 is a cross-sectional view of an example archery bow with a prior art limb bolt in a first adjusted position relative to the riser.

The pivotal motion of the head portion relative to the shank portion makes it possible to maintain greater surface area contact between the head portion and the limb during tightening of the limb bolt to secure the limb to the riser. The increased surface area contact may provide, for example, improved securement of the limb to the riser, reduced vibrations and chatter (i.e., vibration and other relative movement between the limb and limb bolt) in the archery bow, and reduced variations in performance of the archery bow for a given adjusted position of the limb bolt relative to the riser. The pivotal features of the limb bolt may provide improved ease in reproducing a tiller for a given limb. Another benefit of the pivotal feature is reduction of a bending moment in the limb bolt due to application of force being symmetric around the shank of the limb bolt, not just on one side as shown in FIG. 12. This significantly reduces a flex in the limb bolt assembly (i.e., no bending in shank) and reduces movement in the limb bolt assembly that may cause inaccuracy.

Referring now to FIGS. 1-5, an example archery bow 10 is shown and described. The archery bow 10 includes a handle assembly 12 and a bow string 14. The handle assembly 12 includes a riser 20, an upper limb 22, and a lower limb 24. The upper and lower limbs 22, 24 are connected to the riser 20 with a limb bolt assembly 26 and a limb connector 28. The limb bolt assembly 26 includes the pivotal head features described above. The limb bolt assembly 26 and limb connector 28 provide two connections points for each of the upper and lower limbs, 22, 24 to the riser 20. Other archery bow arrangements may include only a single connection point of each of the upper and lower limbs 22, 24 to the riser 20 using, for example, only the limb bolt assembly 26.

Figure 1:
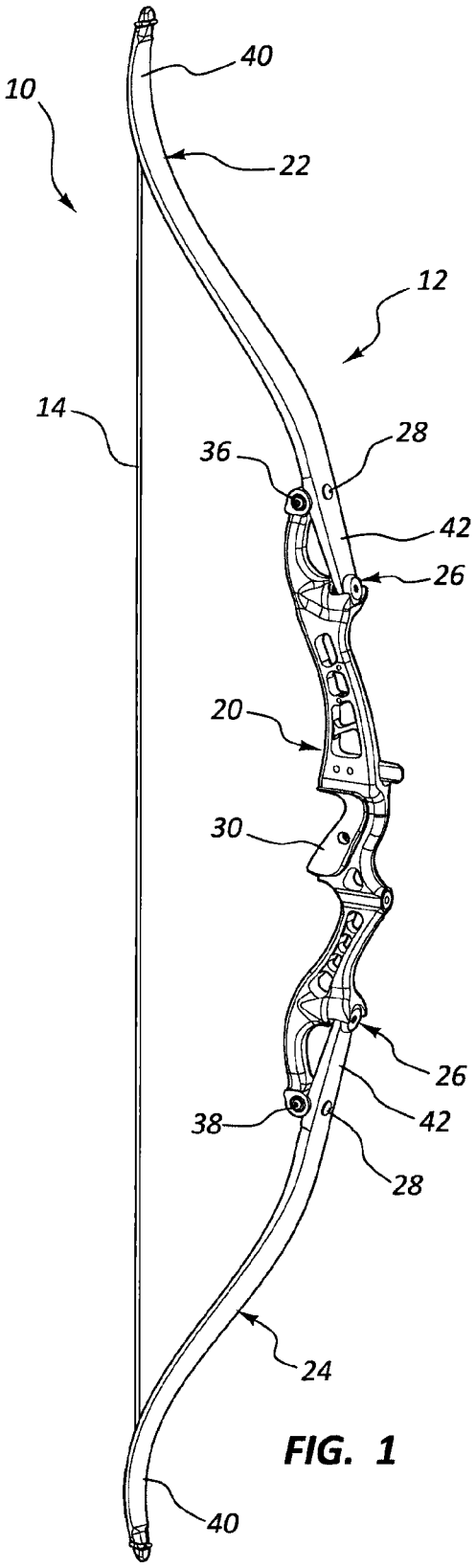
FIG. 1 is a perspective view of an example traditional archery bow in accordance with the present disclosure.
Figure 2:
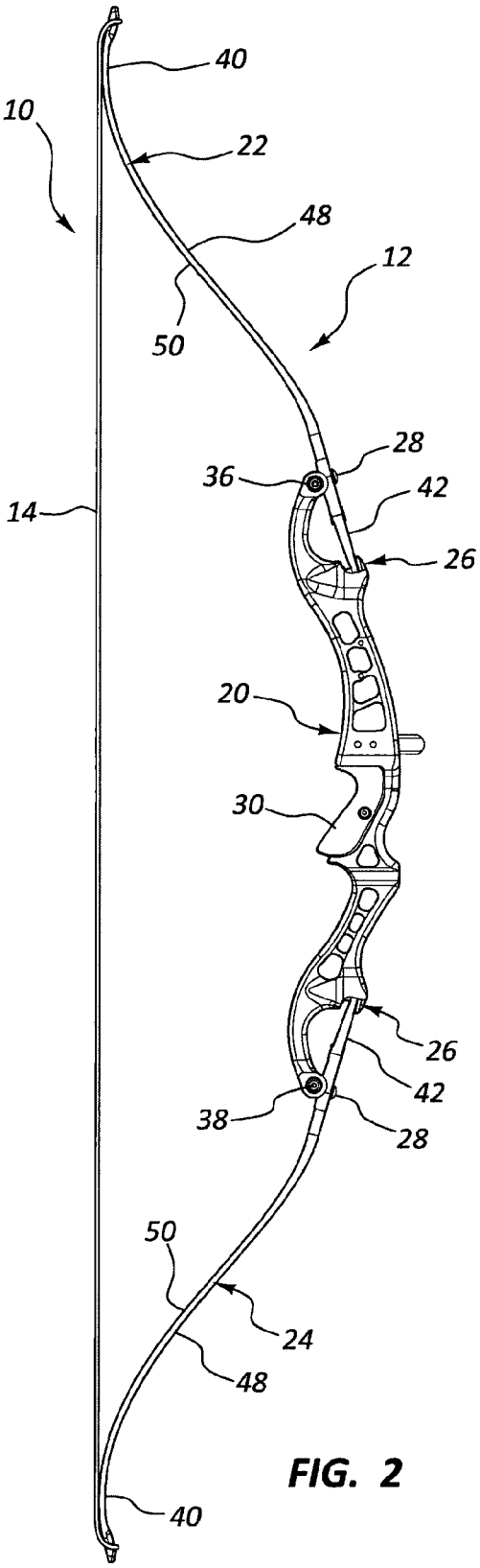
FIG. 2 is a side view of the archery bow of FIG. 1.
Figure 3:
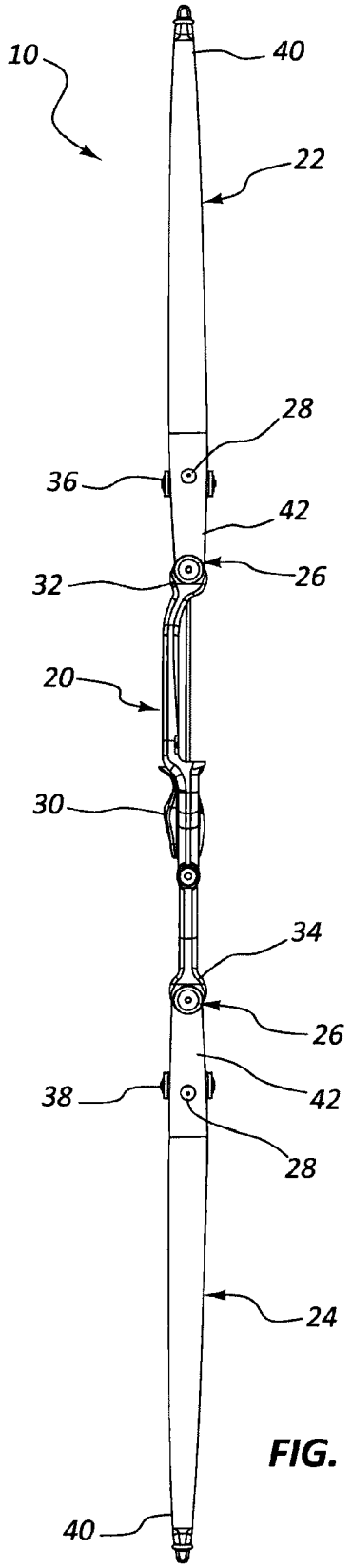
FIG. 3 is a front view of the archery bow of FIG. 1.
Figure 4:
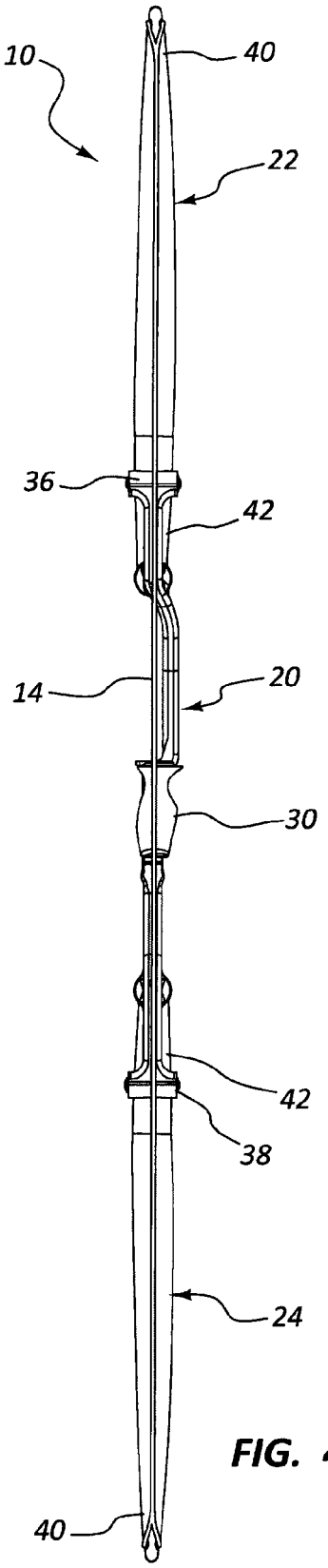
FIG. 4 is a rear view of the archery bow of FIG. 1.
Figure 5:
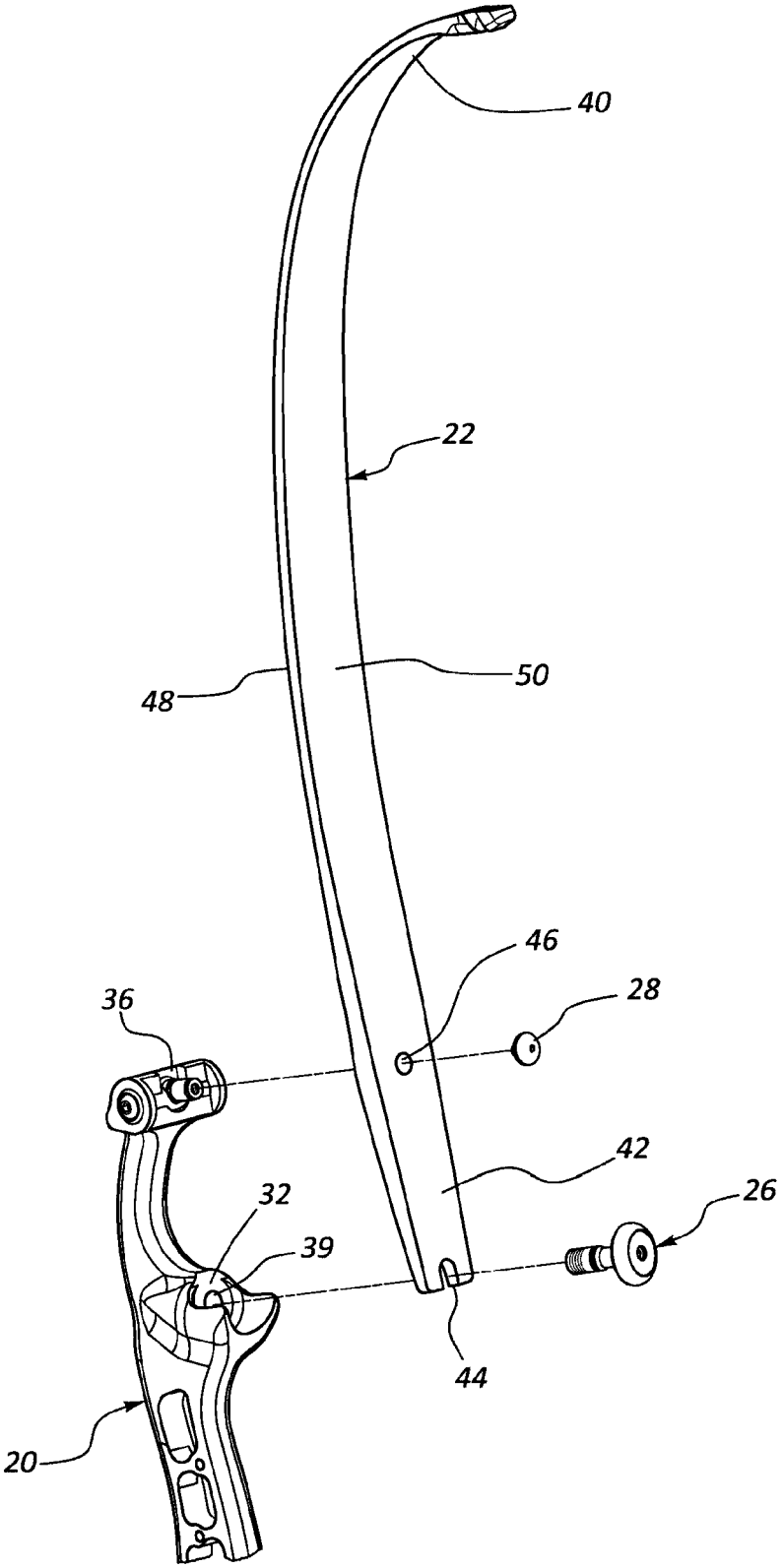
FIG. 5 is an exploded view of a portion of a handle assembly of the archery bow of FIG. 1.

The riser 20 includes a grip 30, first and second limb pockets 32, 34 (see FIG. 3), first and second limb supports 36, 38, and a limb aperture 39 associated with each of the first and second limb pockets 32, 34 (see FIG. 5). The user typically grasps the grip 30 to hold the archery bow 10 in an upright position as shown in FIGS. 1-4. The handle assembly 12 is typically positioned facing forward during use with the bow string 14 positioned rearward on the archery bow 10. The upper and lower limbs 22, 24 are connected to the riser 20 along a front-facing surface of the riser 20.

Each of the upper and lower limbs 22, 24 includes distal and proximal end portions 40, 42, a bolt slot 44 formed in the proximal end portion 42, a connector aperture 46, and front and rear surfaces 48, 50. The proximal end portion 42 is mounted to the riser 20. The distal end portion 40 is connected to the bow string 14.

Figure 9:
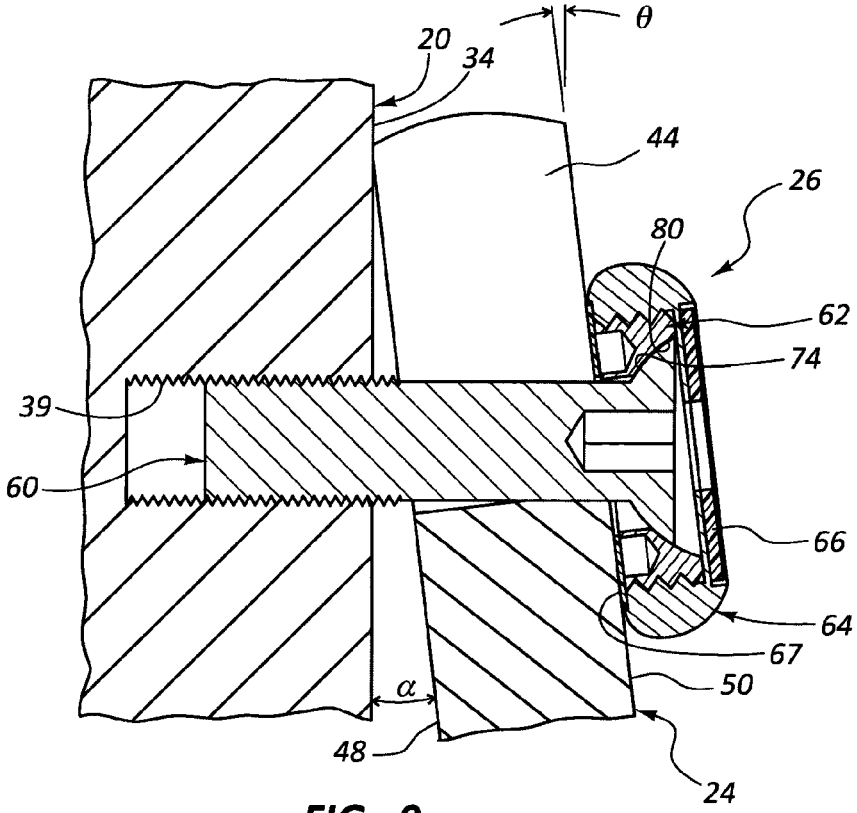
FIG. 9 is a cross-sectional view of a portion of the archery bow of FIG. 1 with the limb bolt in a first adjusted position relative to the riser.
Figure 10:
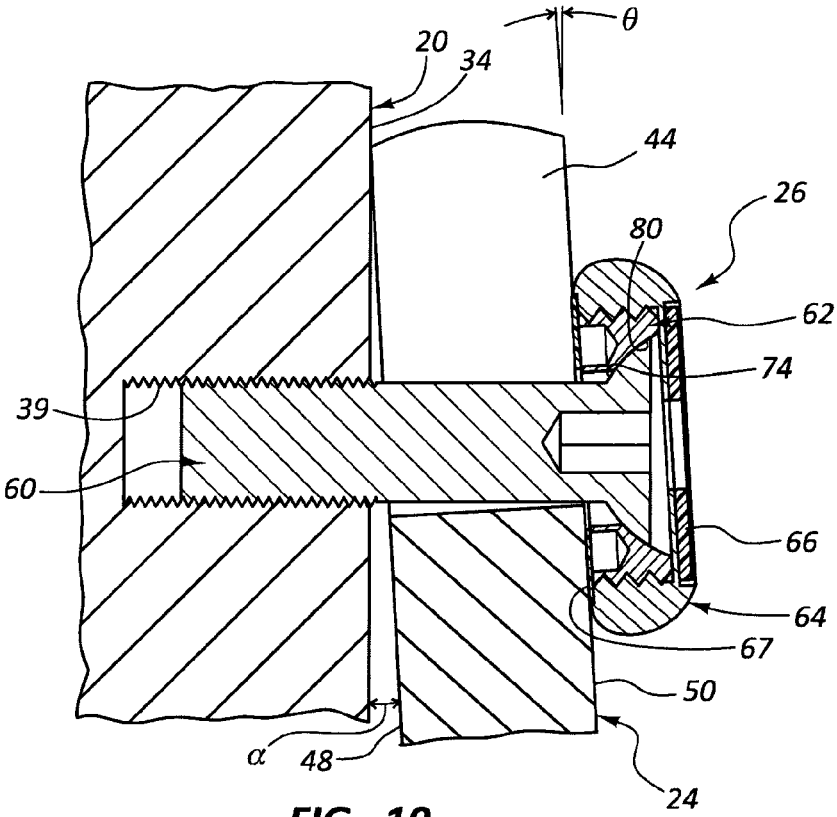
FIG. 10 is a cross-sectional view of a portion of the archery bow of FIG. 1 with the limb bolt in a second adjusted position relative to the riser.
Figure 11:
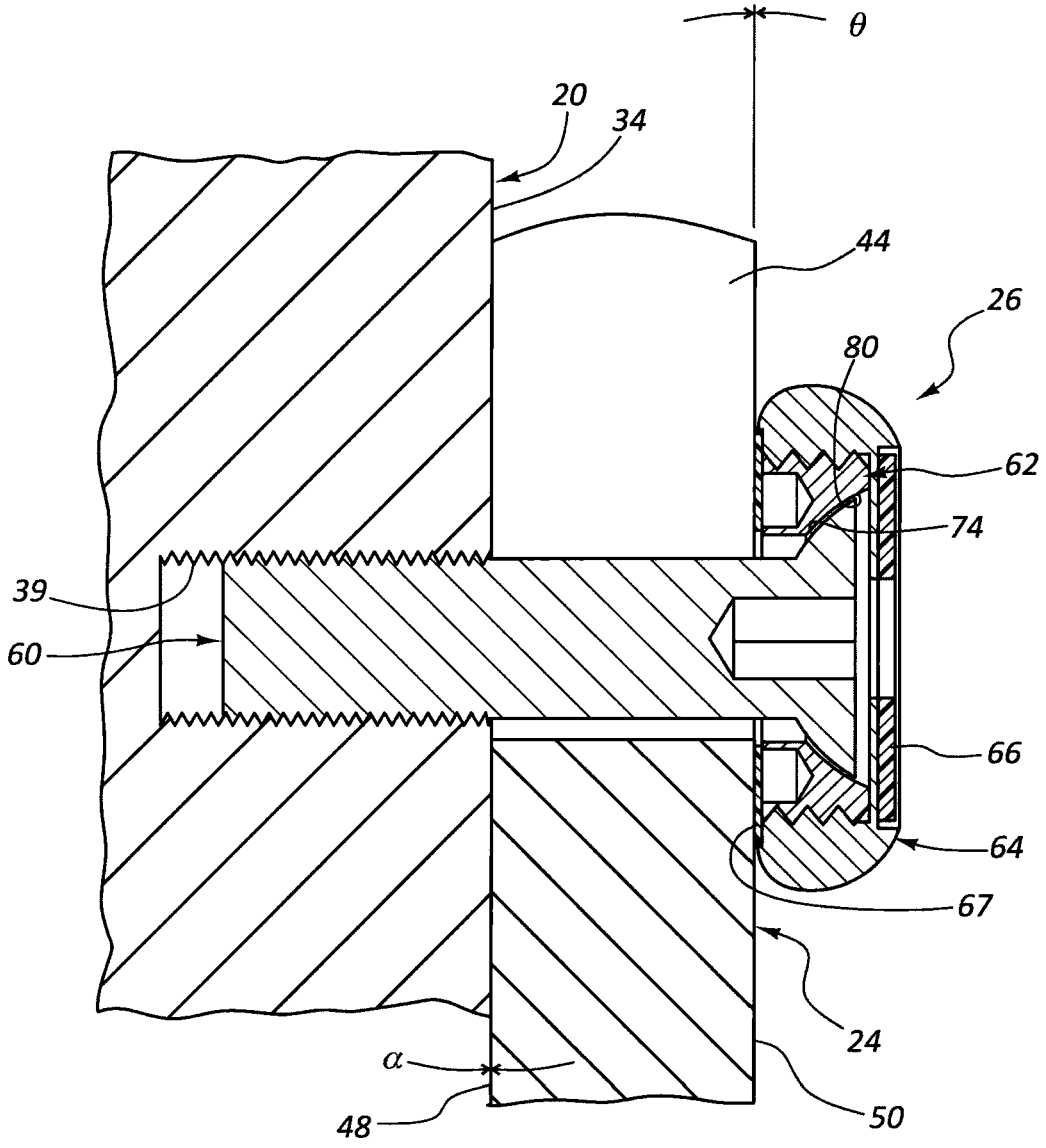
FIG. 11 is a cross-sectional view of a portion of the archery bow of FIG. 1 with the limb bolt in a third adjusted position relative to the riser.

Typically, the limb bolt assembly 26 is connected to the limb bolt aperture 39 in the first and second limb pockets 32, 34 of the riser 20 and arranged in a first adjusted position. The bolt slot 44 (see FIG. 5) is inserted laterally into a gap defined between the limb bolt assembly 26 and the riser 20 so that the limb bolt assembly 26 is positioned within the bolt slot 44. Adjusting the limb bolt assembly 26 toward and away from the riser 20 within the limb bolt aperture 39 adjusts an angled orientation of the limb relative to the limb pockets 32, 34. This angled relationship between the limb and riser is represented by angle $\alpha$ as shown in FIGS. 9-11. Typically, maximum securement of the limb to the riser is obtained when the angle $\alpha$ is equal to about 0°, which maximizes surface contact between the limb and riser and between the head portion of the limb bolt assembly and the limb.

Figure 6:
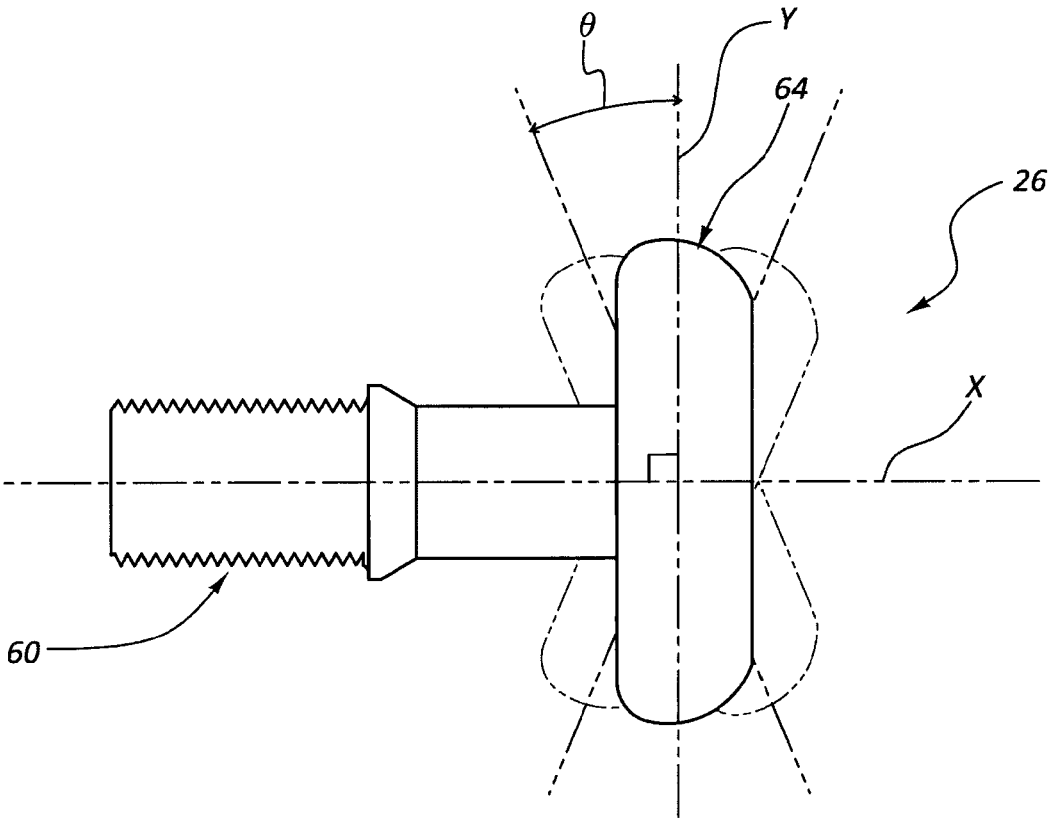
FIG. 6 is a side view of an example limb bolt assembly in accordance with the present disclosure.
Figure 7:
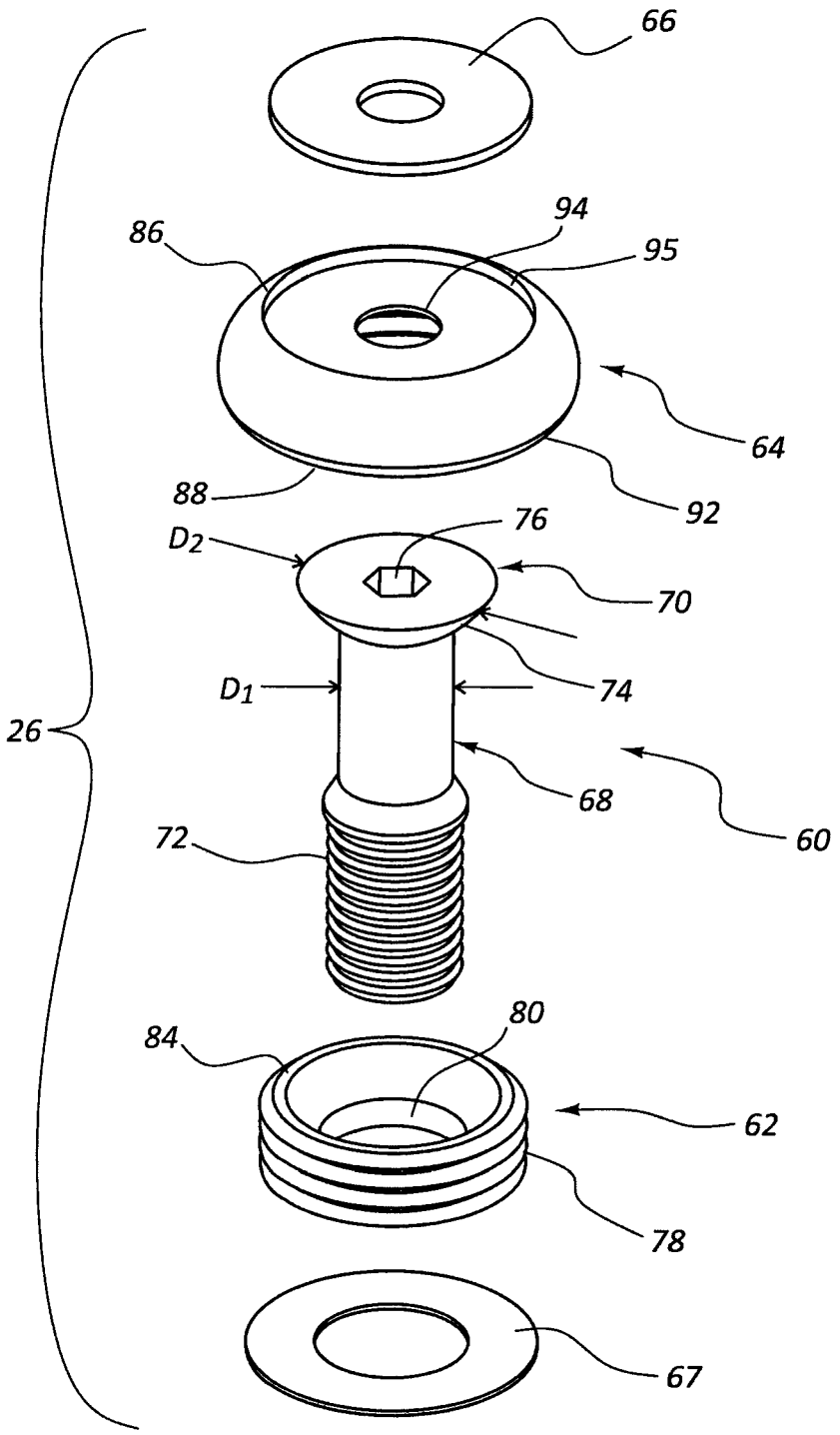
FIG. 7 is an exploded perspective view of the limb bolt assembly of FIG. 6.
Figure 8:
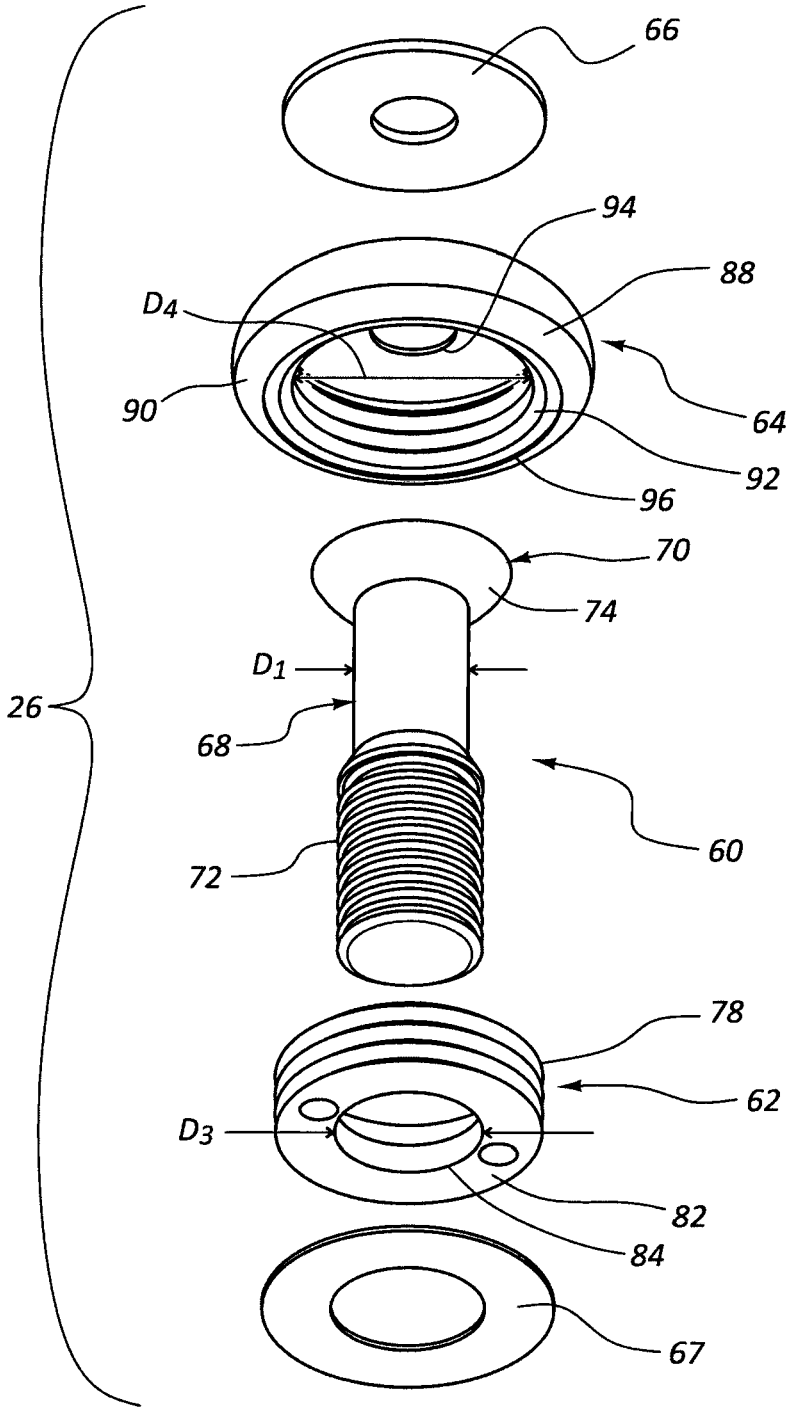
FIG. 8 is another exploded perspective view of the limb bolt assembly of FIG. 6.

Referring now to FIGS. 6-8, the limb bolt assembly 26 is shown including a bolt 60, a bottom bearing connector 62, a top connector 64, a cover plate 66 (e.g., ornamental in nature), and a limb interface member 67. The cover plate 66 may be affixed to the top connector 64. The limb interface member 67 may be connected directly to the limb. Alternatively, interface member may optionally not be used. The bottom connector 62 and the top connector 64 are threaded together and may be referred to as a head portion of the limb bolt assembly 26. Together, the top connector 64 and the bottom connector 62 form a pocket which holds the bolt head inside of the pocket and yet allows the bolt head to move freely relative to the connectors 62, 64. When the top and bottom connectors 64, 62 are secured about the bolt head, the entire bolt assembly remains secured together to allow rapid assembly and disassembly of the archery bow. The bottom connector 62 and top connector 64 may be moveable (e.g., through a pivot movement) together relative to the bolt 60. The bolt system, including the bottom connector 62, top connector 64, cover plate 66, and limb interface member 67 may, in combination, be referred to as a head portion of the limb bolt system or assembly 26. FIGS. 6 and 9-11 show the head portion (represented by the top connector 64) being moveable through an angle $\theta$ relative to a longitudinal axis X of the limb bolt assembly 26. The angle $\theta$ is typically in the range of about 45° to about 135°, and more preferably in the range of about 60° to about 120°. In addition to being rotatable through the angle $\theta$ as shown in FIG. 6, the head portion of the limb bolt assembly 26 may also freely rotate about the axis X. The pivot angle $\theta$ may be available for any rotated position of the head portion about the axis X.

Referring to FIGS. 7 and 8, the bolt 60 includes a shank 68 and a bearing head 70. The shank 68 includes a threaded portion 72 and may have a diameter $D_1$. The bearing head 70 may include a head bearing surface 74, a tool aperture 76, and a diameter $D_2$. The head bearing surface 74 may have a contoured shape. In one example, the head bearing surface 74 may have a generally hemispherical shape. The tool aperture 76 may be configured to receive a tool used to rotate the bolt 60 about its longitudinal axis. The tool aperture 76 may have, for example, a hexagonal cross-sectional shape sized to receive an Allen wrench.

The bottom connector 62 may include a plurality of washer threads 78 positioned on an exterior surface thereof, a washer bearing surface 80, a limb facing surface 82, and a bolt aperture 84 having a diameter $D_3$. The washer threads 78 may be used to connect the bottom connector 62 to the top connector 64. Other connection features are possible in place of threads such as, for example, snap-fit features, fasteners, clips, or brackets.

The washer bearing surface 80 may have a contoured shape. The washer bearing surface 80 may have a generally hemispherical shape. The washer bearing surface 80 may substantially match the shape (e.g., curvature) of the head bearing surface 74 of the bolt 60.

The limb facing surface 82 may be arranged facing the limb and riser of the archery bow. The limb facing surface 82, in some embodiments, may be arranged to contact the limb.

The bolt aperture 84 is sized to receive the shank 68 of the bolt 60. The diameter $D_3$ of the bolt aperture 84 may be greater than the shank diameter $D_1$. The difference in size between the diameters $D_1$ and $D_3$ may permit an increased range of pivotal movement between the bolt 60 and bottom connector 62 as compared to diameters $D_1$ and $D_3$ being similar in size.

The top connector 64 may include top and bottom surfaces 86, 88, a skirt 90 having a plurality of skirt threads 92 formed on an inner surface thereof, and first and second apertures 94, 96. The top surface 86 typically faces away from the riser, while the bottom surface 88 faces the limb and riser. The bottom surface 88 may be arranged in parallel with the limb facing surface 82 of the bottom connector 62, and the bottom connector 62 and top connector 64 are connected together. In some arrangements, the bottom surface 88 may be positioned axially further toward the limb and riser and include a recess sized to receive the limb interface member 67. In one embodiment, the limb interface member 67 defines the entire surface of the head portion that interfaces with the limb. In other arrangements, portions of the limb facing surface 82 in addition to the limb interface member 67 define the surface that contacts the limb. In other arrangements, no separate limb interface member is included.

The skirt 90 has an inner diameter and skirt threads 92 sized to threadably engage the washer threads 78 of the bottom connector 62. The first aperture 94 is sized to permit passage of a tool such as an Allen wrench that is inserted in the tool aperture 76 of the bolt 60. The second aperture 96 is sized to permit insertion of the bottom connector 62 into the top connector 64. A recess 95 may be defined in the top surface 86 adjacent to and surrounding the first aperture 94 to permit positioning of the cover plate 66. The cover plate 66 may include, for example, engravings, graphics, symbols, or other information that convey, for example, product information, source of goods, etc.

In another embodiment, the bottom and top connectors 62, 64 are constructed as a single, integral piece with first aperture 94 sized to receive shank 68 with threaded portion 72 of bolt 60. The cover plate 66 may be then be connected to the single piece bottom and top connectors 62, 64 with the bolt 60 captured there between to keep the single piece bottom and top connectors 62, 64 in contact with the bolt 60.

Various components of the limb bolt assembly 26 may comprise materials having the properties of, for example, strength, durability, and lightweight. In one example, at least portions of the limb bolt assembly 26 comprise aluminum, aluminum alloy, or other metal alloys. In other arrangements, various types of materials, such as composite fiber reinforced thermoplastics and thermoset materials, and moldable polymers may be used for one or more portions of the limb bolt assembly 26. For example, the limb interface member 67 or portions of the bottom connector 62 and top connector 64 that interface with the limb may comprise a low friction material such as PTFE (Teflon) to help reduce wear between the limb bolt assembly 26 and the limb. In other arrangements, those features of the limb bolt assembly 26 that interface with the limb may comprise a high friction material that helps limit movement between the head portion of the limb bolt assembly and the limb. Some example high friction materials that may be suitable for use include Urethane, Santoprene, Ethylene Propylene Diene Monomer (EPDM), silicon rubbers, and Phenolic resin cloth.

Referring now to FIGS. 6 and 9-11, the limb bolt assembly 26 is shown in various adjusted positions relative to the riser 20 to secure the lower limb 24 to the riser 20. FIG. 9 shows the limb bolt assembly 26 in a first adjusted position with the head portion at an angle θ relative to an axis Y (see FIG. 6) that is arranged perpendicular to a longitudinal axis X (see FIG. 6) of the bolt 60 and the lower limb 24 arranged at an angle α relative to the second limb pocket 34 of the riser 20. Typically, the angles θ and α are substantially the same. However, depending on construction of the lower limb 24 (e.g., variations in thickness, taper angles, etc.) and the head portion of the limb bolt assembly 26, the angles θ and α may be different in some embodiments.

FIG. 9 illustrates how the entire surface of the head portion of the limb bolt assembly 26 that faces the lower limb 24 is maintained in contact with the surface 50 of the lower limb 24 with the lower limb 24 arranged at a maximum angle α relative to the riser 20. In some arrangements, the surface of the head portion that faces the lower limb 24 contacts the lower limb 24 at multiple locations.

FIG. 10 illustrates the limb bolt assembly 26 in a second adjusted position relative to the riser 20 such that the head portion of the limb bolt assembly 26 is at a different angle θ that is smaller than the angle θ shown in FIG. 9 and greater than 0°. The entire surface of the head portion of the limb bolt assembly 26 that faces the lower limb 24 is maintained in contact with the surface 50 of the lower limb 24 in the second adjusted position.

FIG. 11 shows a third adjusted position of the limb bolt assembly 26 with the angles θ and α equal to about 0°. The arrangement of FIG. 11 provides maximum surface area contact between the riser 20 and the lower limb 24 and between the head portion of the limb bolt assembly 26 and the lower limb 24. In all adjusted positions of the limb bolt assembly 26 different from the positions shown in FIG. 11, the limb bolt assembly 26 is able to maintain significant surface contact with the limb that provides at least some of those advantages discussed above including, for example, improved securement of the limb to the riser, reduced vibrations, improved consistency in obtained a desired tiller, repeatability of an adjusted position of the limb to the riser, and reduced chatter associated with the connection provided by the limb bolt assembly 26. These advantages are realized in comparison to a prior art limb bolt (see FIGS. 12-14) that does not include a head portion that is moveable (i.e., pivotable) relative to a shank of the limb bolt.

Figure 13:
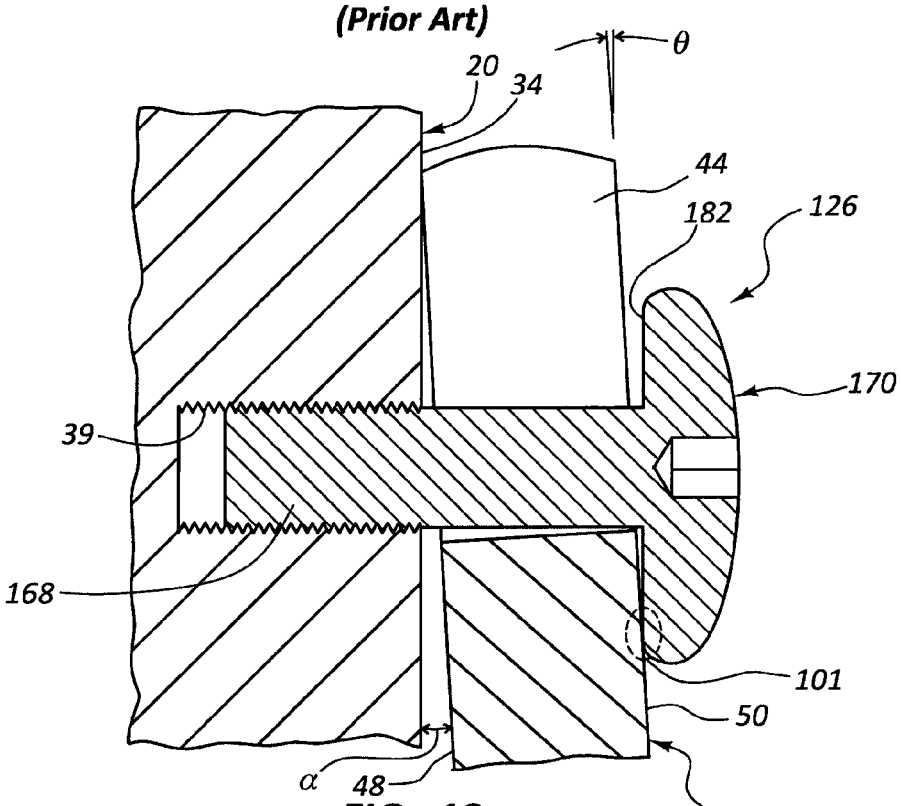
FIG. 13 (Prior Art)
FIG. 13 is a cross-sectional view of the archery bow and limb bolt of FIG. 12 with the limb bolt in a second adjusted position relative to the riser.
Figure 14:
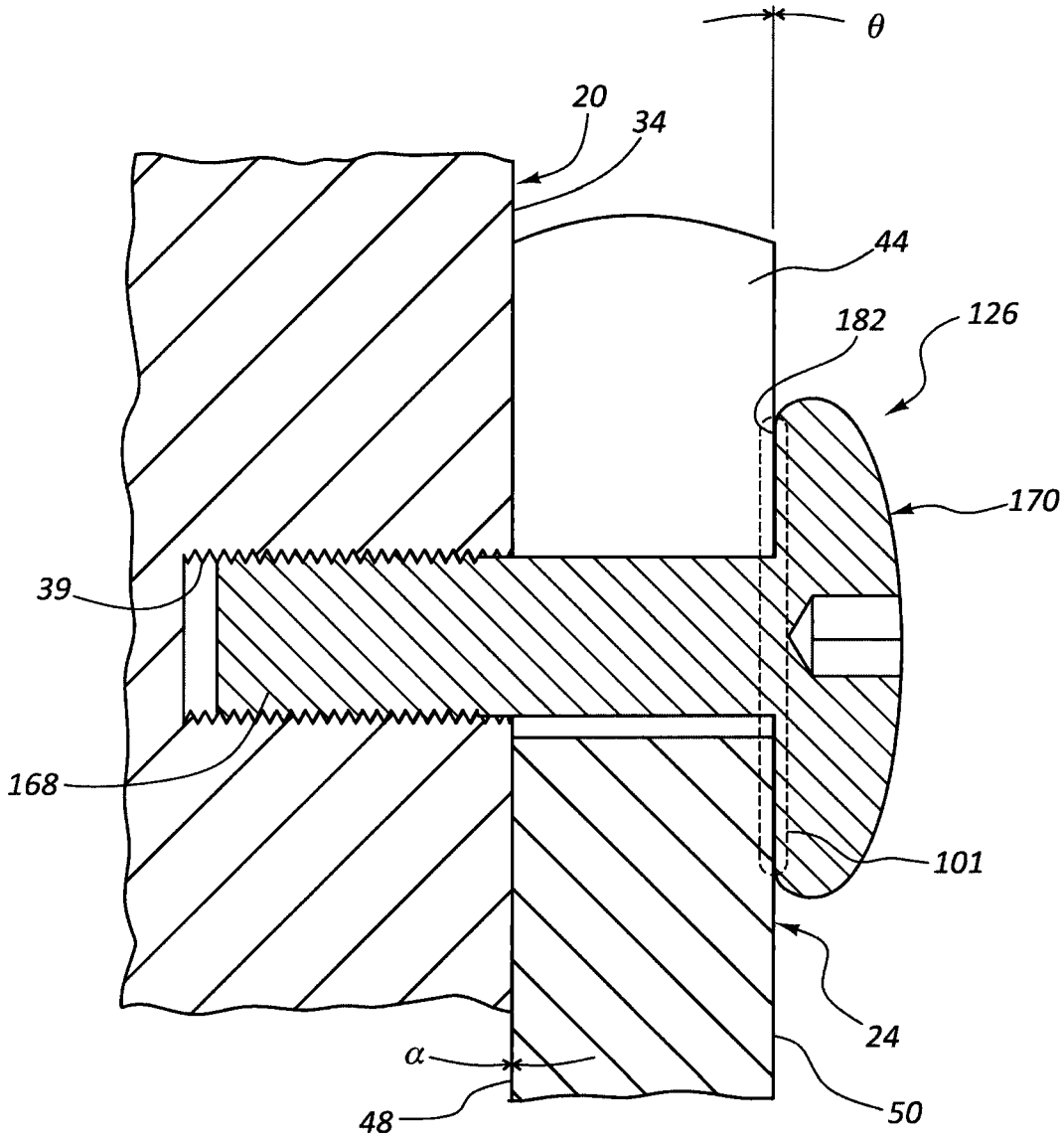
FIG. 14 (Prior Art)
FIG. 14 is a cross-sectional view of the archery bow and limb bolt of FIG. 12 with the limb bolt in a third adjusted position relative to the riser.

FIGS. 12-14 illustrate a prior art limb bolt 126 that includes a shank 168 and a head 170 providing a contact surface 182 that contacts a surface of the limb at a contact point 101. FIG. 12 shows the limb bolt 126 in a first adjusted position. The contact point 101 changes to different locations across the contact surface 182 and moves to different locations along a length of the lower limb 24 as shown in a comparison of FIGS. 12-14. These variations in the interface between the head 170 and the lower limb 24 may create variability in the performance of the archery bow and make it difficult to provide repeatable adjustment of the tiller and other features of the archery bow. Furthermore, the point or line contact resulting from each adjusted position of the limb bolt 126, except the final stop position shown in FIG. 14, provides limited contact that results in chatter potential lateral and axial movement of the limb relative to the riser and limb bolt, and other undesirable outcomes. The pivotal head portion of the limb bolt assembly 26 described herein, particularly in the context of a traditional archery bow that is broken down and reassembled frequently, addresses many of the shortcomings of prior art devices such as the device shown in FIGS. 12-14.

A method of assembling an archery bow in accordance with features of the limb bolt assembly 26 described herein includes, in a first assembly step, the limb bolt assembly 26 being threadably connected to the limb bolt aperture 39 of the riser 20 and adjusted to a first adjusted position. One of the upper and lower limbs 22, 24 is inserted into the respective limb pocket 32, 34 until the shank 68 of the limb bolt assembly 26 is lodged within the bolt slot 44 of the limb. A tool may be used to rotate the limb bolt assembly 26 into different adjusted positions to adjust the angle α between the limb and the riser to adjust, for example, the tiller or other adjustment features of the archery bow. The head portion of the limb bolt assembly 26 rotates or pivots relative to the bolt 60 (i.e., a change in the angle θ) as the angle α changes during adjustment of the limb bolt assembly 26.

In a further assembly step, the other limb is connected to the riser 20 with a limb bolt assembly 26 and adjusted as desired. The bow string 14 is then connected to the handle assembly 12 and the archery bow 10 is operational. A user may further adjust the limb bolt assemblies 26 relative to the riser 20 to adjust the angle α for each limb. Typically, an entire surface area of that portion of the head portion of limb bolt assembly 26 that faces and is exposed to the rear surface 50 of the limb remains in contact with the limb during adjustment of the limb bolt assembly 26.

It should be noted that for purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front" "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A traditional archery bow assembly, comprising:

a handle assembly including a riser, an upper limb, and a lower limb, the upper and lower limbs each including a proximal end connected to the riser and a distal end;

a bowstring extending between the distal ends of the upper and lower limbs;

a first limb bolt assembly operable to connect one of the upper and lower limbs to the riser, the first limb bolt assembly comprising a bolt and a movable head portion, the bolt having a shank portion, a fixed, integral head portion, and a head bearing surface, the movable head portion defining a contact surface that faces and contacts the upper limb, the movable head portion slidably contacting the head bearing surface at a curved bearing interface formed therebetween to allow the movable head portion to move relative to the shank portion, wherein the movable head allows an angle between the contact surface and a longitudinal axis of the bolt shank to change.

2. The traditional archery bow of claim 1 wherein shank portion includes a convex bearing surface and the movable head portion includes a concave bearing surface that interfaces with the convex bearing surface.

3. The traditional archery bow of claim 1 wherein the movable head portion includes a bottom connector and a top connector, the bottom connector including the head bearing surface, and the top connector being operable to secure the bottom connector to the shank portion.

4. The traditional archery bow of claim 3 wherein at least one of the bottom connector and the top connector define a planar limb contact surface that maintains contact with the upper or lower limb during angled adjustment of the upper or lower limb relative to the riser.

5. The traditional archery bow of claim 4 wherein the entire limb contact surface maintains contact with the upper or lower limb during angled adjustment.

6. The traditional archery bow of claim 3 wherein the movable head portion further comprises a cover plate mounted to the movable head portion on a side of the movable head portion opposite the upper or lower limb.

7. The traditional archery bow of claim 1 wherein the movable head portion further comprising a limb interface member that defines an interface between the movable head portion and the upper or lower limb.

8. The traditional archery bow of claim 1 wherein the shank portion includes a threaded end that threadably engages a threaded bore of the riser.

9. The traditional archery bow of claim 1 wherein movable head portion is pivotal relative to the shank portion.

10. A recurve archery bow handle assembly comprising:

a riser;

upper and lower recurve limbs extending from opposite ends of the riser;

a limb bolt assembly configured to releasably connect one of the upper and lower recurve limbs to the riser, the limb bolt assembly comprising:

a shank portion having a shank head, the shank head including a shank bearing surface and a head bearing surface;

a movable head portion having a bottom connector and a top connector, the bottom connector including a head bearing surface that interfaces with the head bearing surface at a curved bearing interface to provide pivotal movement between the shank portion and the movable head portion, and the top connector connecting the bottom connector to the shank portion;

wherein the movable head allows an angle between the contact surface and a longitudinal axis of the bolt shank to change.

11. The recurve archery bow handle assembly of claim 10, wherein the movable head portion remains in contact with the upper or lower recurve limb when adjusting an angled orientation of the upper or lower recurve limb relative to the riser.

12. The recurve archery bow handle assembly of claim 10, wherein the shank portion and movable head portion include mating hemispherical bearing surfaces to provide the pivotal movement.

13. The recurve archery bow handle assembly of claim 10, wherein moving the shank portion into and out of threaded engagement with the riser adjusts an angled orientation of the upper or lower recurve limb relative to the riser.

14. A method of assembling a traditional archery bow, comprising:

providing a riser, upper and lower limbs, and a first limb bolt assembly, the first limb bolt assembly including a shank portion comprising a head bearing surface and a movable head portion that contacts and is movable relative to the head bearing surface;

threadably connecting the first limb bolt assembly to the riser;

positioning a proximal end of one of the upper and lower limbs between the riser and the first limb bolt assembly with the contact surface arranged facing and in contact with the one of the upper and lower limbs;

adjusting the first limb bolt assembly relative to the riser to change an angled orientation of the one of the upper and lower limbs relative to the riser and to position the movable head portion to face and contact the proximal end;

slidably moving the movable head portion relative to the head bearing surface portion along a curved bearing interface formed by the head bearing surface and the movable head portion to allow change in an angle between the contact surface and a longitudinal axis of the shank portion while adjusting the one of the upper and lower limbs relative to the riser.

15. The method of claim 14, further comprising:

providing a second limb bolt assembly;

positioning a proximal end of the other of the upper and lower limbs between the riser and the lower limb bolt assembly;

adjusting the second limb bolt assembly relative to the riser to change an angled orientation of the other of the upper and lower limbs relative to the riser;

pivoting the movable head portion relative to the shank portion of the second limb bolt assembly while adjusting the other of the upper and lower limbs relative to the riser.

16. The method of claim 14, wherein the shank portion includes a convex bearing surface and the movable head portion includes a concave bearing surface that interfaces with the convex bearing surface.

17. The method of claim 14, wherein the movable head portion includes a planar limb contact surface that faces and maintains contact with the one of the upper and lower limbs during adjusting of the one of the upper and lower limbs relative to the riser.

18. The method of claim 14, wherein adjusting the first limb bolt assembly relative to the riser includes moving the shank portion into and out of the riser.

19. The method of claim 14, wherein the movable head portion includes a bottom connector and a top connector, the bottom connector having a shank bearing surface and the shank portion extending through the bottom connector, the top connector threadably connecting the bottom connector to the shank portion.

* * * * *